US011621480B2

(12) United States Patent
Wada et al.

(10) Patent No.: US 11,621,480 B2
(45) Date of Patent: Apr. 4, 2023

(54) PROTECTIVE MEMBER AND COMMUNICATION TERMINAL DEVICE INCLUDING THE SAME

(71) Applicant: AGC INC., Tokyo (JP)

(72) Inventors: Naoya Wada, Tokyo (JP); Masao Ozeki, Tokyo (JP)

(73) Assignee: AGC INC., Tokyo (JP)

( * ) Notice: Subject to any disclaimer, the term of this patent is extended or adjusted under 35 U.S.C. 154(b) by 0 days.

(21) Appl. No.: 17/343,920

(22) Filed: Jun. 10, 2021

(65) Prior Publication Data

US 2021/0391646 A1 Dec. 16, 2021

(30) Foreign Application Priority Data

Jun. 12, 2020 (JP) ..... JP2020-102549

(51) Int. Cl.

| | |
|---|---|
| ***H01Q 1/40*** | (2006.01) |
| ***H01Q 1/38*** | (2006.01) |
| ***H01Q 1/00*** | (2006.01) |
| ***H01Q 3/44*** | (2006.01) |

(52) U.S. Cl.

CPC ..... *H01Q 1/40* (2013.01); *H01Q 1/002* (2013.01); *H01Q 1/38* (2013.01); *H01Q 3/44* (2013.01)

(58) Field of Classification Search

CPC ..... H01Q 1/38; H01Q 3/44; H01Q 1/002; H01Q 1/243; H01Q 1/40; H01Q 1/405

See application file for complete search history.

(56) References Cited

U.S. PATENT DOCUMENTS

| | | | | |
|---|---|---|---|---|
| 2016/0241690 | A1* | 8/2016 | Sim | H05K 9/0086 |
| 2016/0359517 | A1* | 12/2016 | Roberts | H01Q 1/422 |
| 2018/0186685 | A1 | 7/2018 | Murayama et al. | |
| 2018/0265397 | A1 | 9/2018 | Murayama et al. | |
| 2018/0319706 | A1 | 11/2018 | Murayama et al. | |
| 2018/0327304 | A1 | 11/2018 | Murayama et al. | |
| 2019/0194057 | A1 | 6/2019 | Murayama et al. | |
| 2019/0263713 | A1 | 8/2019 | Murayama et al. | |
| 2019/0292099 | A1 | 9/2019 | Murayama et al. | |
| 2021/0053867 | A1 | 2/2021 | Murayama et al. | |

FOREIGN PATENT DOCUMENTS

| | | | | |
|---|---|---|---|---|
| JP | 20171940 A | * | 1/2017 | C03C 15/00 |
| KR | 1020140116065 A | * | 10/2014 | H01Q 21/29 |
| WO | WO 2017/126607 A1 | | 7/2017 | |

* cited by examiner

*Primary Examiner* — Hoang V Nguyen

(74) *Attorney, Agent, or Firm* — Oblon, McClelland, Maier & Neustadt, L.L.P.

(57) ABSTRACT

The present invention relates to a protective member having a plate shape, including: a first base material that is a chemically strengthened glass, and a second base material provided in a hole recessed or penetrating in a thickness direction of the first base material and formed of a material different from a material forming the first base material, in which with respect to values of relative permittivity and dielectric loss tangent at a frequency of 10 GHz of the first base material and the second base material, the value of at least either one of the relative permittivity and the dielectric loss tangent of the second base material is smaller than the value of the relative permittivity or the dielectric loss tangent of the first base material.

19 Claims, 12 Drawing Sheets

PROTECTIVE MEMBER AND COMMUNICATION TERMINAL DEVICE INCLUDING THE SAME

TECHNICAL FIELD

The present invention relates to a protective member and a communication terminal device including the same.

BACKGROUND ART

A surface of a communication terminal device such as mobile phone and smartphone is covered with a plate-shaped protective member such as cover glass. As the protective member, for example, Patent Literature 1 discloses a chemically strengthened glass having a surface residual stress of 300 MPa or more Patent Literature 1: International Publication WO2017/126607

SUMMARY OF INVENTION

Meanwhile, communication in a fifth-generation mobile communication system (5G), etc. uses radio waves at a frequency band of several GHz to several tens of GHz bands. Therefore, the protective member for a communication terminal device using radio waves at a frequency band of, for example, 28 GHz band is further required to reduce a propagation loss while ensuring a protective function. However, the chemically strengthened glass disclosed in Patent Literature 1 contains an alkali metal such as Na, K and Li and therefore, has a high dielectric loss tangent and a large dielectric loss. Consequently, it has been difficult to increase the radio wave permeability.

An object of the present invention is to provide a protective member enabling good communication by reducing the radio wave propagation loss while ensuring the protective function, and a communication terminal device including the same.

Namely, the present invention relates to the following configurations (1) and (2).

(1) A protective member having a plate shape, including:

a first base material that is a chemically strengthened glass, and a second base material provided in a hole recessed or penetrating in a thickness direction of the first base material and formed of a material different from a material forming the first base material, in which with respect to values of relative permittivity and dielectric loss tangent at a frequency of 10 GHz of the first base material and the second base material, the value of at least either one of the relative permittivity and the dielectric loss tangent of the second base material is smaller than the value of the relative permittivity or the dielectric loss tangent of the first base material.

(2) A communication terminal device including:

the protective member according to (1), and a protection target to which the protective member is attached.

With the protective member according to the present invention, good communication is performed by reducing the radio wave propagation loss while ensuring the protective function.

In addition, with the communication terminal device according to the present invention, a protection target can be protected while reducing the radio wave propagation loss.

DESCRIPTION OF EMBODIMENTS

Figure 1:
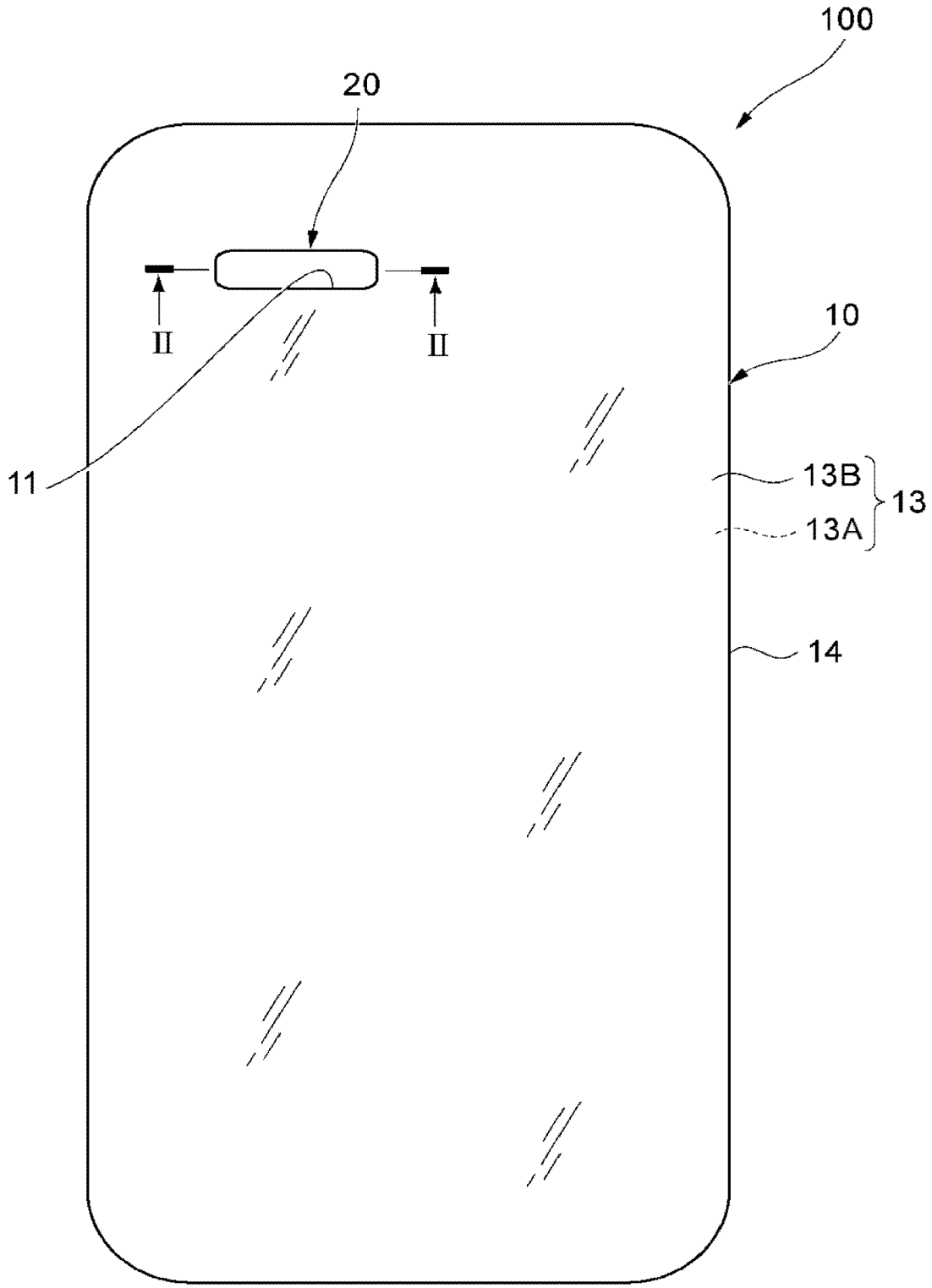
FIG. 1 is a plan view of the protective member according to a first embodiment of the present invention.

The embodiments of the present invention are described in detail below by referring to the drawings.

In the present description, the protective member according to the present invention is described taking, as an example, a cover glass of a smartphone that is one of communication terminal devices, but the target to which the protective member is applicable is not limited thereto.

Also, in the following description, the numerical range expressed using "to" indicates a range including the numerical values before and after "to" as a minimum value and a maximum value, respectively.

<Configuration of Protective Member> [First Embodiment]

Figure 2:
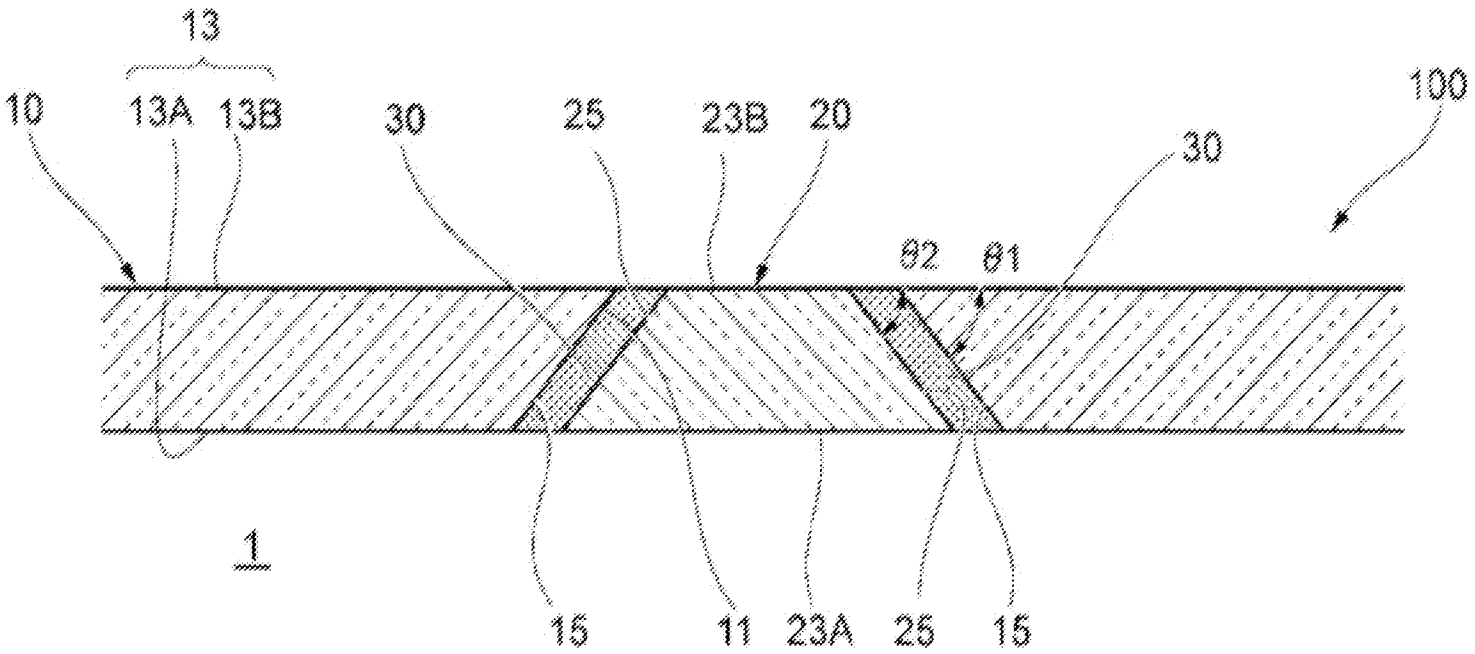
FIG. 2 is a cross-sectional view taken along line II-II of the protective member shown in FIG. 1.

FIG. 1 is a plan view of the protective member according to a first embodiment of the present invention. FIG. 2 is a cross-sectional view taken along line II-II of the protective member illustrated in FIG. 1.

A protective member 100 is attached to a protection target 1 and protects the protection target 1.

The protection target 1 is, for example, a device body of a communication terminal device such as smartphone, and, for example, the frequency band of a fifth-generation mobile communication system (5G) is used as the radio wave for communication. In this case, the frequency band of radio waves is a band including, for example, 3.7 GHz, 4.5 GHz, 10 GHz, 28 GHz, or a frequency higher than 28 GHz.

The protective member 100 protects the protection target 1 by covering at least either one of a front surface on the side where a display portion of a liquid crystal display, etc. serving as the protection target 1 is provided, and a rear surface on the opposite side of the front surface. In addition, the protective member 100 sometimes covers a lateral surface connecting the front surface and the rear surface of the protection target 1. The protective member 100 is formed in plate shape along the outer surface such as front surface, rear surface or lateral surface of the protection target 1. Here, as illustrated in FIGS. 1 and 2, a surface of the protective member 100 has a pair of main surfaces 13 (13A, 13B) and a lateral surface 14 (see, FIG. 1) connecting the pair of main surfaces 13 (13A, 13B) with each other. The pair of main surfaces 13 have an inner-side surface 13A defining the protection target 1 side and an outer-side surface 13B defining the opposite side of the inner-side surface 13A in the thickness direction.

A thickness of the protective member 100 (a thickness of the first base material) is 1.5 mm or less, preferably 1 mm or less, more preferably 0.8 mm or less, and as the thickness is smaller, the visibility of a liquid crystal display, etc. is more increased. In addition, the preferable thickness is 0.05 mm or more, and in this case, the strength of the protective member 100 can be ensured.

The protective member 100 illustrated here includes a first base material 10 and a second base material 20. The protective member 100 is mainly includes the first base material 10, and the second base material 20 is provided in a partial region along the main surface 13 of the first base material 10. That is, the second base material 20 illustrated in FIG. 2 is provided to have at least a region not overlapping with the first base material 10 in the thickness direction of the first base material.

The first base material 10 is formed of a material A, and the second base material 20 is formed of a material B different from the material A. The material A and the material B are described briefly here, and details thereof are described later.

With respect to values of relative permittivity Dk and dielectric loss tangent Df at a frequency of 10 GHz of the first base material 10 and the second base material 20, the value of at least either one of the relative permittivity Dk and dielectric loss tangent Df of the second base material 20 is smaller than the value of the relative permittivity Dk or the dielectric loss tangent Df of the first base material 10. Furthermore, the relative permittivity Dk at a frequency of 10 GHz of the second base material 20 is preferably 6 or less. In addition, the dielectric loss tangent Df at a frequency of 10 GHz of the second base material 20 is preferably 0.01 or less.

Here, the relative permittivity Dk and the dielectric loss tangent Df can be measured, for example, by SPDR method or a cavity resonator method.

Accordingly, the electromagnetic permeability at a frequency of 10 GHz in the second base material 20 is higher than that in the first base material 10. Consequently, in the case where the protection target 1 performs communication through the second base material 20, compared with the case of having the first base material 10 alone, the propagation loss can be reduced, and the communication can be successfully performed. A material having a small relative permittivity or dielectric loss tangent at 10 GHz has a tendency to also decrease the relative permittivity or dielectric loss tangent at a frequency band of 28 GHz adopted in the fifth-generation mobile communication system (5G). Therefore, when the protective member 100 of the present configuration is applied to a protection target 1 such as smartphone of the fifth-generation mobile communication system (5G), good communication can be achieved while protecting the protection target 1.

As the material A of the first base material 10, for example, an aluminoborosilicate glass, an aluminosilicate glass, a soda lime silicate glass, or a crystallized glass, etc. may be used. The glass to be used as the first base material 10 is chemically strengthened. Since the first base material 10 is a chemically strengthened glass, the protection target 1 can be more strongly protected. It is preferred that the depth of a compressive stress layer of the chemically strengthened glass is 5 μm or more and a surface compressive stress of the compressive stress layer is 300 MPa or more. A Martens hardness of the material A is preferably from 2,000 $N/mm^2$ to 6,000 $N/mm^2$. In order to effectively perform the chemical strengthening, the total content of alkali metal oxides in the composition of the material A forming the first base material 10 is preferably set to 10 mol % or more.

As the material B of the second base material 20, a quartz glass, an aluminoborosilicate glass, a borosilicate glass, an alkali-free glass, a fluororesin, a polycarbonate resin, an acrylic resin, a urethane acrylate resin, a silicone resin, a cycloolefin polymer resin, a polyimide resin, a low-melting-point frit glass, etc. may be used. The Martens hardness of the material B is preferably from 200 $N/mm^2$ to 6,000 $N/mm^2$, more preferably from 300 $N/mm^2$ to 6,000 $N/mm^2$, still more preferably from 2,000 $N/mm^2$ to 6,000 $N/mm^2$. In the case of forming the second base material 20 from a glass material, in order to decrease the relative permittivity Dk and dielectric loss tangent Df at 10 GHz, the total content of alkali metal oxides in the composition of the material B forming the second base material 20 is preferably 5 mol % or less.

Both the material A of the first base material 10 and the material B of the second base material 20 preferably have transparency to visible light. Each of the average transmittance in the visible light region of the material A and that of the material B is preferably 70% or more, more preferably 75% or more, still more preferably 80% or more. In the case of forming the first base material 10 and the second base material 20 from a glass material, the total content of alkali metal oxides in the composition of the material B forming the second base material 20 is preferably ½ times or less, more preferably 1/10 times or less, still more preferably 1/100 times or less, the total content of alkali metal oxides of the material A forming the first base material 10.

A hole 11 penetrating front and back of the first base material (inner-side surface 13A, outer-side surface 13B) is preferably provided in part of the first base material 10 of the present configuration. In the first base material 10 illustrated in FIG. 1, a hole 11 having a rectangular shape in plan view is provided. The second base material 20 is formed to have a rectangular shape in plan view and fitted in the hole 11 of the first base material 10. The shapes of the hole 11 and the second base material 20 are not limited to a rectangular shape in plan view and may be any shape, for example, in plan view, a circular shape, an oval shape or a polygonal shape such as triangle.

An intermediate material 30 preferably lies between the first base material 10 and the second base material 20, i.e., between the boundary surface 15 of the first base material 10 and the boundary surface 25 of the second base material 20. The intermediate material 30 is, for example, formed of an optical adhesive material, and the boundary surface 15 of the first base material 10 and the boundary surface 25 of the second base material 20 are bonded by the intermediate material 30. The material of the intermediate material 30 is, for example, an epoxy resin, a silicone resin, an acrylic resin, a urethane resin, a urethane acrylate resin, a vinyl chloride resin, or a low-melting-point frit glass. Because of the intermediate material 30, the first base material 10 and the second base material 20 can be easily integrated.

The difference between the refractive index of the intermediate material 30 at the helium d line (wavelength: 587.56 nm) and the refractive index of the first base material 10 at the helium d line, and the difference between the refractive index of the intermediate material 30 at the helium d line (wavelength: 587.56 nm) and the refractive index of the second base material 20 at the helium d line are respectively preferably 0.02 or less, more preferably 0.01 or less, still more preferably 0.005 or less. By reducing the difference between the refractive index of the intermediate material 30 and the refractive index of the first base material 10, and the difference between the refractive index of the intermediate material 30 and the refractive index of the second base material 20, an unpleasant feeling, for example, that a discontinuity is observed in the outer appearance at each boundary surface to inhibit the clarity, is suppressed.

In addition, the intermediate material 30 preferably has a refractive index between the refractive index of the first base material 10 at the helium d line and the refractive index of the second base material 20 at the helium d line. In this case, the refractive-index difference can be more reduced, and the unpleasant feeling in the outer appearance due to difference in the refractive index can be more successfully suppressed. The thickness of the intermediate material 30 is preferably 1 mm or less, more preferably 0.1 mm or less, still more preferably 0.01 mm or less.

(Arrangement of Antenna)

Figure 3:
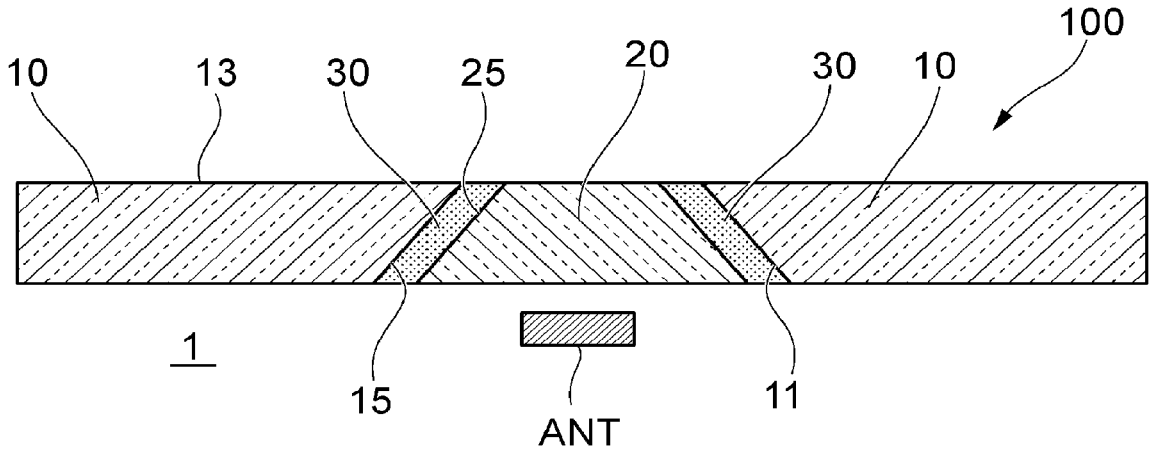
FIG. 3 is a cross-sectional view of a protective member, illustrating an arrangement of an antenna relative to the protective member.

FIG. 3 is a cross-sectional view of a protective member, illustrating an arrangement of an antenna relative to the protective member.

An antenna ANT provided in the protection target 1 is preferably arranged, for example, at a position facing the second base material in a thickness direction of the second base material 20 of the protective member 100. The protection target 1 in which the antenna ANT is arranged in this way performs communication through the second base material 20 facing the antenna ANT and having a high electromagnetic permeability. Accordingly, compared with the case of being covered only with the first base material 10, a communication with a reduced propagation loss can be achieved.

Figure 4:
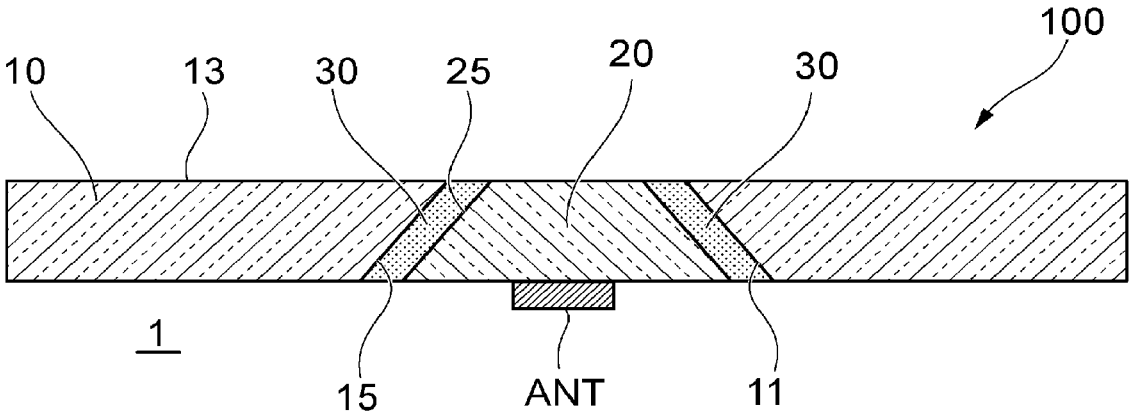
FIG. 4 is a cross-sectional view of a protective member, illustrating another arrangement of an antenna relative to the protective member.
Figure 5:
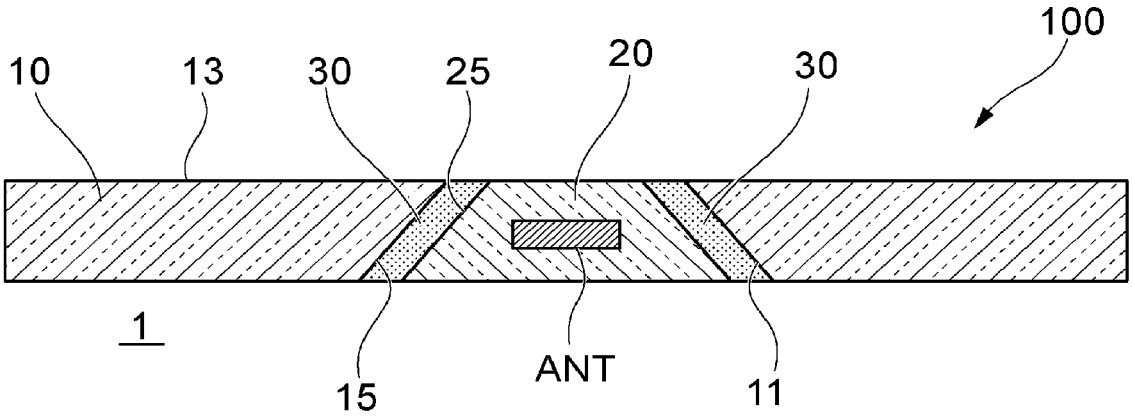
FIG. 5 is a cross-sectional view of a protective member, illustrating another arrangement of an antenna relative to the protective member.

FIG. 4 and FIG. 5 are cross-sectional views of a protective member, illustrating other arrangements of an antenna relative to the protective member.

As illustrated in FIG. 4, the antenna ANT may be arranged on the inner-side surface 23A of the second base material 20, which is on the same side as the inner-side surface 13A of the first base material 10 attached to the protection target 1. In this case, the antenna ATN is arranged on the inner-side surface 23A of the second base material 20, for example, by printing or sticking of an antenna sheet or an antenna chip. The antenna ANT may also be arranged on the same surface as the inner-side surface 23A of the second base material 20 or may be arranged by burying a part of the antenna ANT inside the second base material 20.

According to this configuration, the antenna ANT is previously fixed to the second base material 20 of the protective member 100, and the handleability of the antenna ANT at the time of manufacturing is thereby enhanced. In addition, the antenna ANT can be fixed only by a simple operation such as bonding to the second base material 20, and the workability is enhanced. This makes it possible to perform good communication through the second base material 20 with low loss.

Furthermore, as illustrated in FIG. 5, the antenna ANT may be arranged by burying it inside the second base material 20. In this case, the antenna can be unfailingly protected, and communication with low loss can be performed through the second base material 20.

(Inclination of Boundary Surface)

The boundary surfaces 15 and 25 between the first base material 10 and the second base material 20 are preferably inclined relative to the inner-side surface 13A and the outer-side surface 13B which are the main surfaces 13 of the first base material 10. The boundary surface 15 of the first base material 10 is the inner circumferential surface of the hole 11, and the boundary surface 25 of the second base material 20 is the outer circumferential surface of the second base material 20. According to this configuration, when the protective member 100 is viewed from the front, the boundary surfaces 15 and 25 are hard to visually recognize.

Angles of inclination θ1 and θ2 of the boundary surfaces 15 and 25 relative to the main surface 13 (13A, 13B) (the angle of inclination means a smaller angle out of crossing angles formed by the boundary surface 15 or 25 and the main surface 13) is preferably 20° or more and less than 75°. In order to facilitate the formation of the boundary surface by processing and make the boundary surface after bonding be less visible, the angles of inclination θ1 and θ2 are preferably 20° or more, more preferably 25° or more, still more preferably 30° or more. In order to make the boundary surface after bonding be less visible, the angles of inclination θ1 and θ2 are preferably less than 70°, more preferably less than 60°, still more preferably less than 55°. Here, from the viewpoint of possibly gaplessly bonding the first base material 10 and the second base material 20, it is preferred that θ1 and θ2 are the same value.

Figure 6:
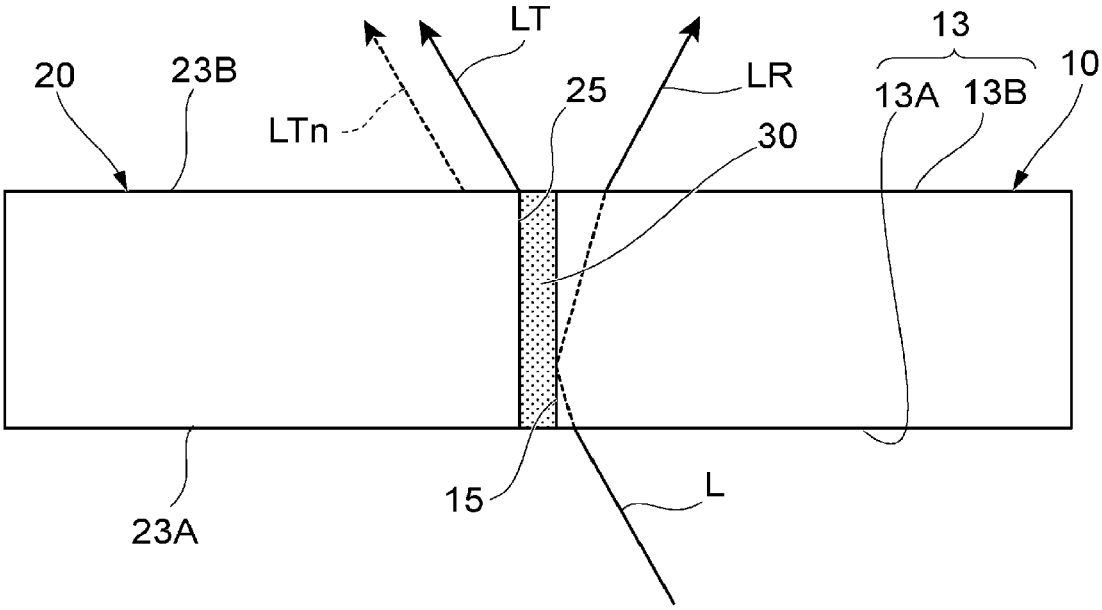
FIG. 6 is a cross-sectional view of the protective member of an Example having a boundary-surface perpendicular to a main surface and is an explanatory view illustrating an incident light path.
Figure 7:
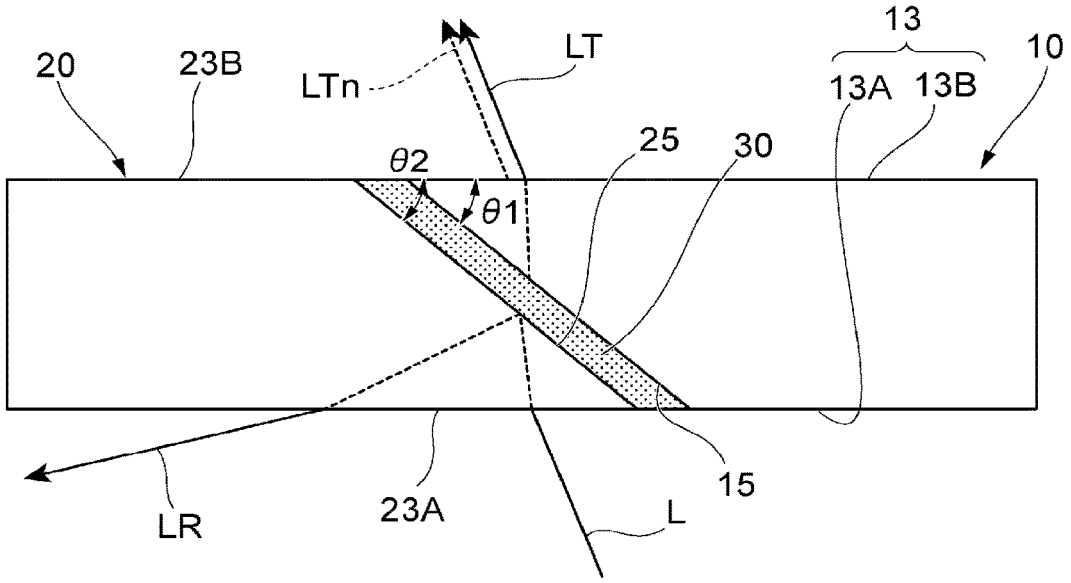
FIG. 7 is a cross-sectional view of a protective member having a boundary-surface inclined relative to a main surface and is an explanatory view illustrating an incident light path.

FIG. 6 is a cross-sectional view of the protective member of an Example having a boundary-surface perpendicular to the main surface 13 and is an explanatory view illustrating an incident light path. FIG. 7 is a cross-sectional view of a protective member having boundary-surfaces 15 and 25 inclined relative to the main surface 13 and is an explanatory view illustrating an incident light path. Incidentally, this explanatory view illustrates one example of the phenomenon, and the explanation therein does not apply depending on the magnitude of the refractive index of each member or the angle of incident light.

When the boundary surfaces 15 and 25 between the first base material 10 and the second base material 20 are perpendicular to the main surface 13 as illustrated in FIG. 6, a light L incident on the inner-side surfaces 13A and 23A (the lower-side surface of FIG. 6) of the protective member 100 is separated into a transmitted light LT having passed through the boundary surface 15 (the same with 25) and exiting to the outside, and a reflected light LR having reflected from the boundary surface 15 (the same with 25) and exiting to the outside. In other words, the transmitted light LT and the reflected light LR are emitted to the outer-side surfaces 13B and 23B of the protective member 100. The reflected light LR is a light beam that is not present when not having boundary surfaces 15 and 25. Also, shifting of the transmitted light LT from a transmitted light LTn obtained when not having boundary surfaces 15 and 25 increases. For these reasons, when the protective member 100 is viewed with eyes from the outer-side surface 13B or 23B side of the protective member 100, the boundary surfaces 15 and 25 are visually conspicuous. In addition, if the refractive-index difference between the first base material 10 and the second base material 20 is large, the transmitted light LT decreases, and an unpleasant feeling is likely to occur at the boundary surfaces.

On the other hand, when the boundary surfaces 15 and 25 between the first base material 10 and the second base material 20 are inclined relative to the main surface 13 as illustrated in FIG. 7, the light L incident on the inner-side surfaces 13A and 23A of the protective member 100 are separated into a transmitted light LT having passed through the boundary surfaces 15 and 25 and exiting to the outside, and a reflected light LR having reflected from the boundary surfaces 15 and 25 and returning to the inner-side surfaces 13A and 23A of the protective member 100. Accordingly, only the transmitted light LT is emitted to the outer-side surface of the protective member 100. Also, shifting of the transmitted light LT from a transmitted light LTn obtained when not having boundary surfaces 15 and 25 is small. In particular, when the inclination angles θ1 and θ2 of the boundary surfaces 15 and 25 relative to the main surface 13 are set to be 20° or more and less than 75°, the boundary surfaces 15 and 25 are still less visible. Furthermore, the refractive-index difference between the first base material 10 and the second base material 20 is reduced, and this makes it possible to suppress a decrease of the transmitted light LT and prevent occurrence of an unpleasant feeling at the boundary surface.

In this way, when the protective member 100 is viewed with eyes from the outer-side surface 13B or 23B side of the protective member 100, the boundary surfaces 15 and 25 can be made less visible, and high design properties can be maintained without impairing the outer appearance of the protective member 1.

Incidentally, the surface (inner-side surface 13A, 23A) on the side where the protective member 100 is attached to the protection target 1 is not limited to the surface on the side where the second base material 20 is fitted in the hole 11, and may be the surface on the opposite side of the fit-in side.

[Second Embodiment]

In the protective member 100 of the first embodiment, the hole 11 penetrating front and back of the first base material is formed in the first base material 10, and the second base material 20 is attached by fitting it in the hole 11, but the configuration of attaching the second base material 20 to the first base material 10 is not limited to the fitting in the hole 11 penetrating front and back of the first base material.

Figure 8:
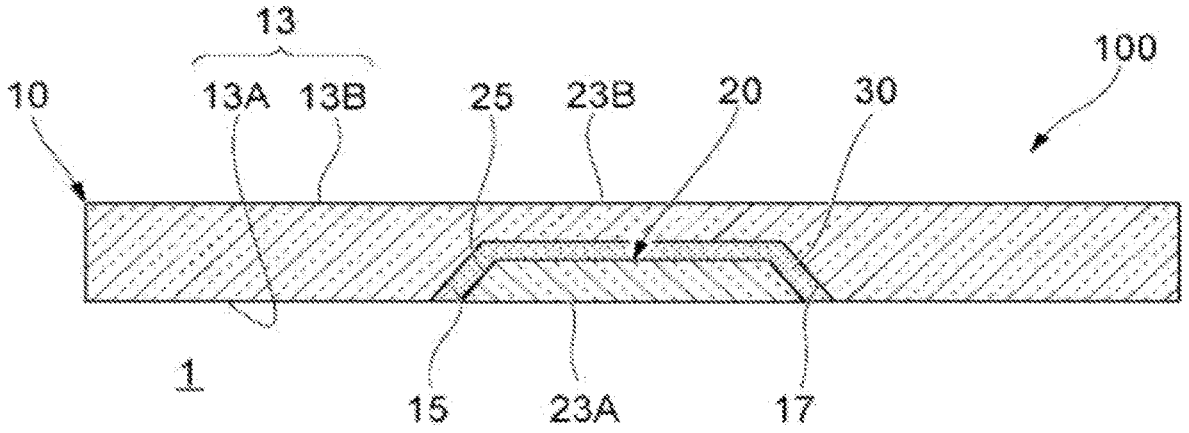
FIG. 8 is a cross-sectional view of a protective member where a second base material is fitted in a hole that is formed in a first base material and recessed in the thickness direction of the first base material.
Figure 9:
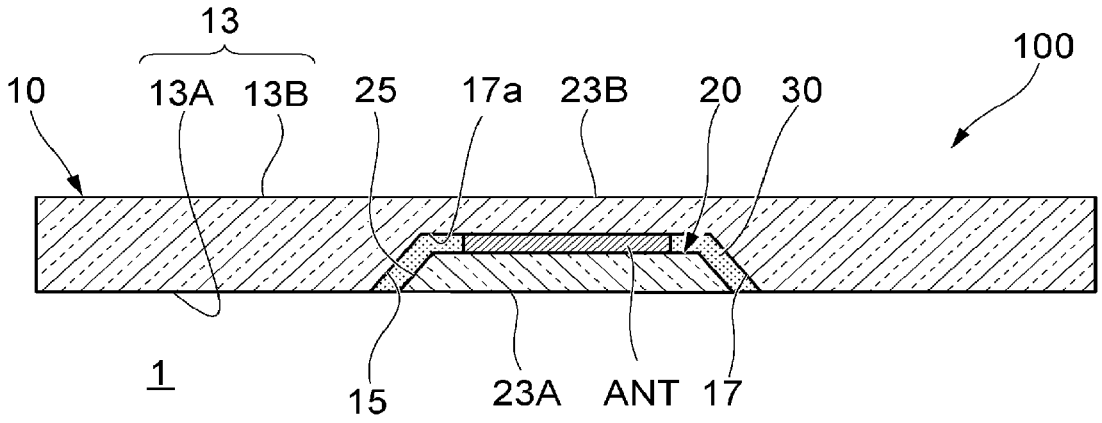
FIG. 9 is a cross-sectional view of a protective member, illustrating an arrangement of an antenna in a protective member where a second base material is fitted in a hole that is formed in a first base material and recessed in the thickness direction of the first base material.

FIG. 8 is a cross-sectional view of a protective member 100 where a second base material 20 is fitted in a hole (recess) 17 that is formed in a first base material 10 and recessed in the thickness direction of the first base material. FIG. 9 is a cross-sectional view of a protective member, illustrating an arrangement of an antenna ANT in a protective member 100 where a second base material 20 is fitted in the hole (recess) 17 that is formed in the first base material 10 and recessed in the thickness direction of the first base material.

As illustrated in FIG. 8, the first base material 10 of this protective member 100 has a hole 17 formed by a thinning of the wall from the inner-side surface 13A. The second base material 20 is fitted in the hole 17 of the first base material 10 through an intermediate material 30 and thereby bonded and fixed. According to this protective member 100, the outer-side surface 13B is an opening-free smooth surface. Accordingly, the tactile sensation in the outer-side surface 13B is not affected by any means, and moreover, the outer appearance can be improved. In addition, in the case where, as illustrated in FIG. 8, the boundary surface extending in the thickness direction of the hole 17 is inclined relative to the inner-side surface 13A and the outer-side surface 13B which are the main surfaces 13 of the first base material 10, the inclined boundary-surface is visually inconspicuous. Furthermore, when the refractive index of the second base material 20 is set to come close to or preferably coincide with the refractive index of the first base material 10, the bottom of the hole 17 is also visually inconspicuous.

In such a structure of fitting the second base material 20 in the hole 17 of the first base material 10, as illustrated in FIG. 9, an antenna ANT may be arranged by fitting it between a bottom surface 17*a* of the hole 17 and a surface facing the inner-side surface 23A of the second base material 20 (top surface of the second base material 20 in FIG. 9). This arrangement can facilitate integrating the first base material 10 and the second base material 20.

[Third Embodiment]

Figure 10A:
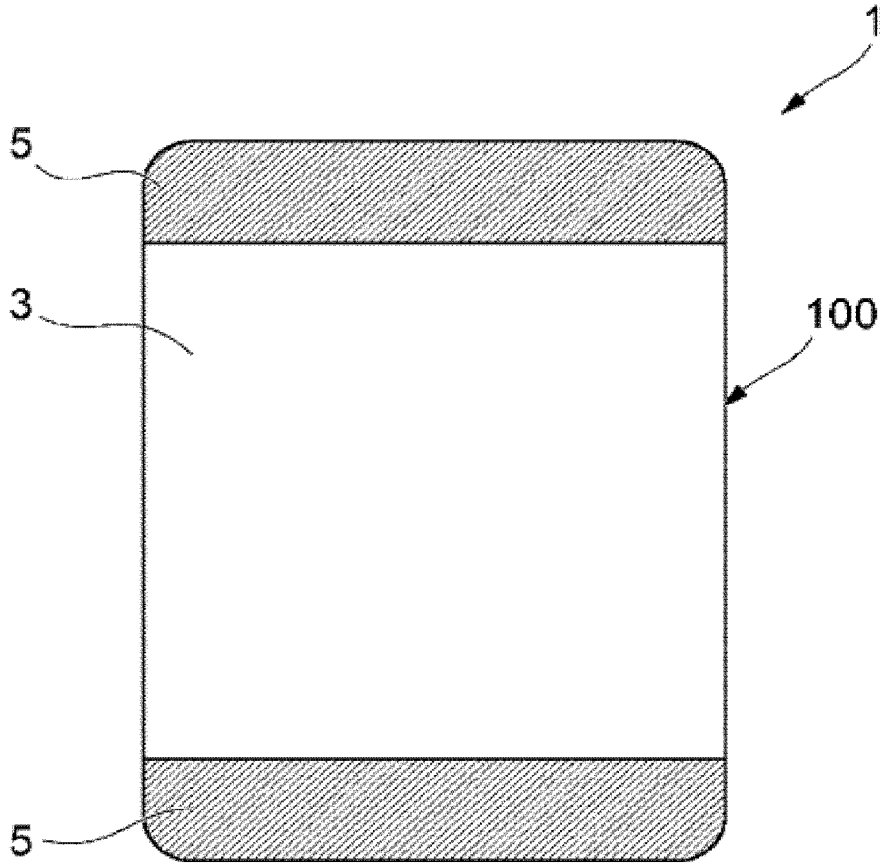
FIGS. 10A and 10B are schematic front views of Modification Examples, illustrating other arrangement examples of a second base material in a protective member.
Figure 10B:
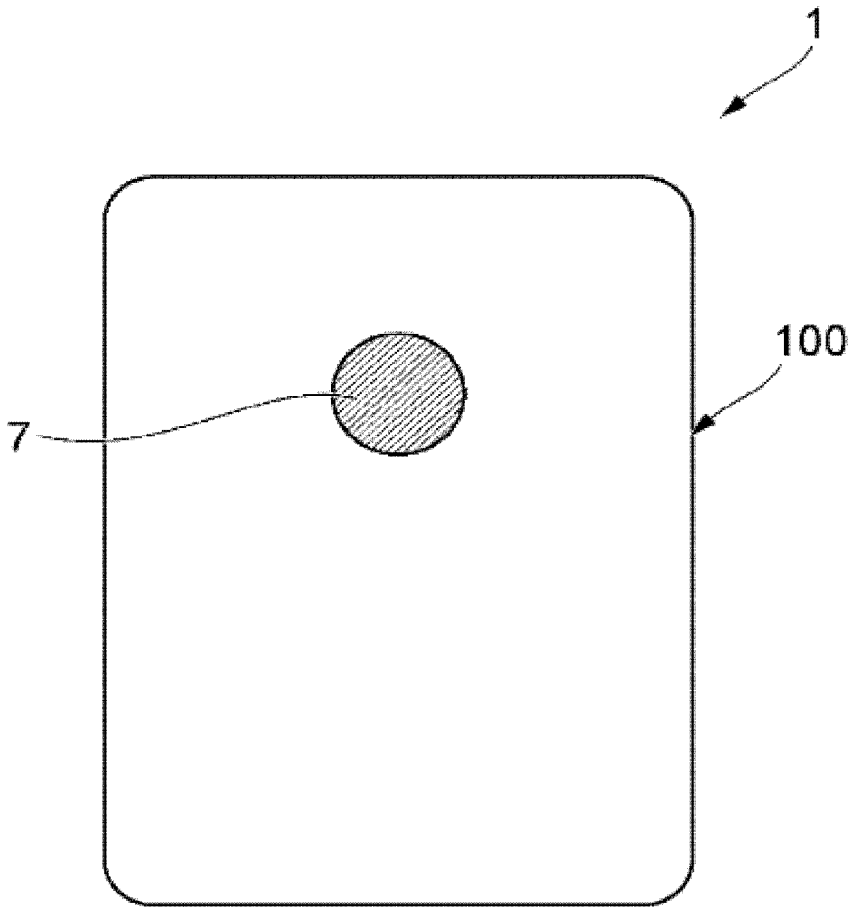

FIGS. 10A and 10B are schematic front views of Modification Examples, illustrating other arrangement examples of the second base material 20 in a protective member. Here, with respect to the protective member 100 illustrated in FIGS. 10A and 10B, the shape (aspect ratio, etc.) thereof is schematically depicted.

As illustrated in FIG. 10A, for example, in the case of providing the protective member 100 on the side (front side) where the display portion of the protection target 1 is arranged, the second base material 20 may be arranged in a non-display region 5 outside the display portion 3. The non-display region 5 is an opaque region where a print layer, etc. is formed on the protective member 100. The second base material 20 has a print layer, etc. and is arranged in this non-display region 5, and the second base material 20 is thereby intentionally arranged to stand out distinctly.

Also, as illustrated in FIG. 10B, in the case of providing the protective member 100 on the side (rear surface side) where the display portion of the protection target 1 is not arranged, the second base material 20 may be arranged at a position of a mark 7 such as symbol mark or logotype, an arbitrary sign, etc. provided on the rear surface of the protection target 1.

In the configuration where the second base material 20 is thus arranged in a non-display region 5 or at a position of a mark 7, etc. in the protection target 1, the second base material 20 need not coincide with the first base material 10 in terms of outer appearance, and consequently, the arrangement freedom degree and design freedom degree of the second base material 20 are enhanced.

[Fourth Embodiment] (Step Between First Base Material and Second Base Material)

As illustrated in FIG. 2, in the case of providing the protective member 100 to cover the display portion on the front surface side of the protection target 1, a step between the outer-side surface 13B of the first base material 10 and the outer-side surface 23B of the second base material 20 in the thickness direction of the first base material is set to preferably 10 μm or less, more preferably 3 μm or less, still more preferably 1 μm or less. In order to reduce the step, after the first base material 10 and the second base material 20 are bonded, the surface may be polished and made flat.

According to this configuration, the visibility of the display portion is not reduced. Also, since the step is small, the tactile sensation or operability in a touch panel is not impaired.

On the other hand, in the case of a protective member 100 covering the rear surface side where the display portion of the protection target 1 is not provided, the visibility of the display portion or the tactile sensation in a touch panel need not be taken into consideration. Accordingly, the step between the first base material 10 and the second base material 20 in the thickness direction of the first base material can be made larger than on the front surface side.

Figure 11:
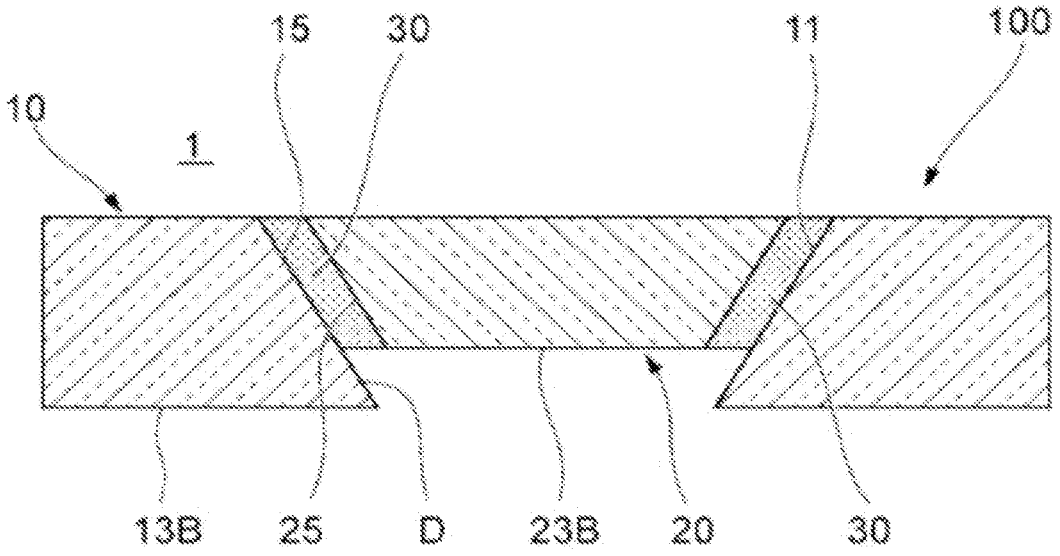
FIG. 11 is a schematic cross-sectional view illustrating a step between a first base material and a second base material of a protective member in the thickness direction of the first base material, the protective member being provided on the rear surface side of a protection target.

FIG. 11 is a schematic cross-sectional view illustrating a step between a first base material and a second base material of a protective member in the thickness direction of the first base material, the protective member being provided on the rear surface side of a protection target.

In the case of providing the protective member 100 on the rear surface side of the protection target 1, a step D of 100 μm or less in the thickness direction of the first base material may be present between the outer-side surface 13B on the rear surface side of the first base material 10 and the outer-side surface 23B on the rear surface side of the second base material 20.

[Fifth Embodiment] (Protective Member Having Curved Portion)

The protective member 100 may have a flat surface portion covering the front surface side or rear surface side of the protection target 1 and a curved portion connected to an edge portion of the flat surface portion. The flat surface portion is composed of the first base material 10, and the curved portion or part of the curved portion is composed of the second base material 20.

Figure 12:
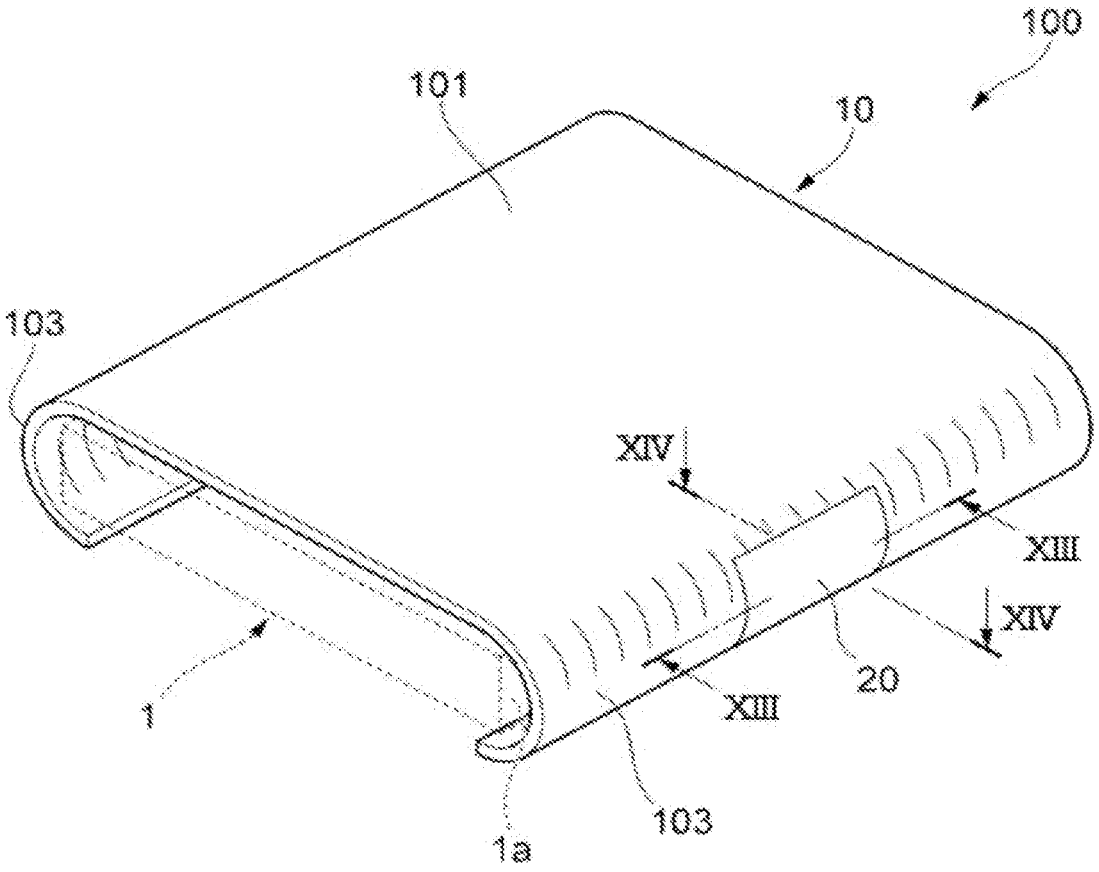
FIG. 12 is a schematic perspective view of a protective member having a curved portion.

FIG. 12 is a schematic perspective view of the protective member 100 having a curved portion 103.

In the protection target 1 here, the display portion on the front surface (top surface of FIG. 12) side is arranged to extend from the edge portion of the front surface and further to the lateral surface 1*a*. In the protective member 100 used for this protection target 1, the curved portion 103 continuing to the flat surface portion 101 is arranged to face the lateral surface 1*a* of the protection target 1.

Figure 13:
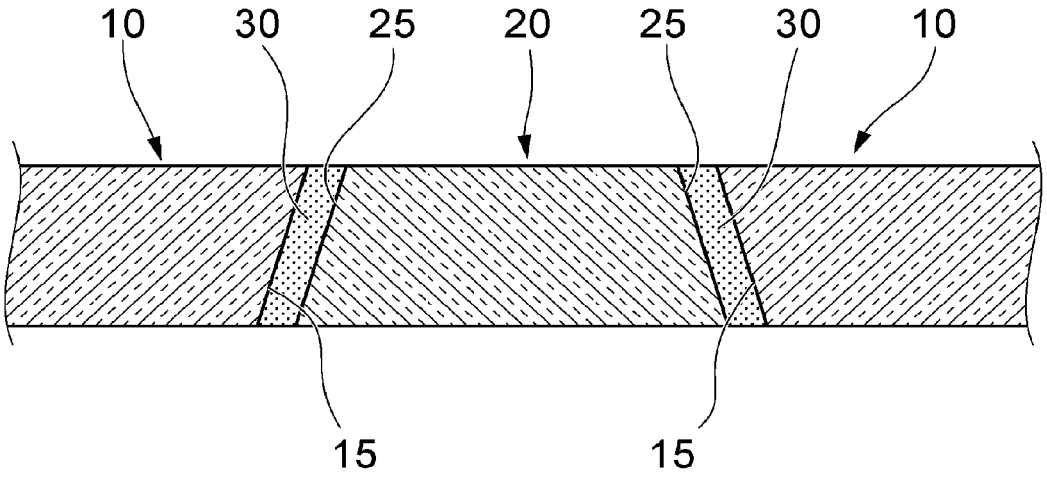
FIG. 13 is a cross-sectional view taken along line XIII-XIII of the protective member illustrated in FIG. 12 when a display portion is arranged on a lateral surface of a protection target.
Figure 14:
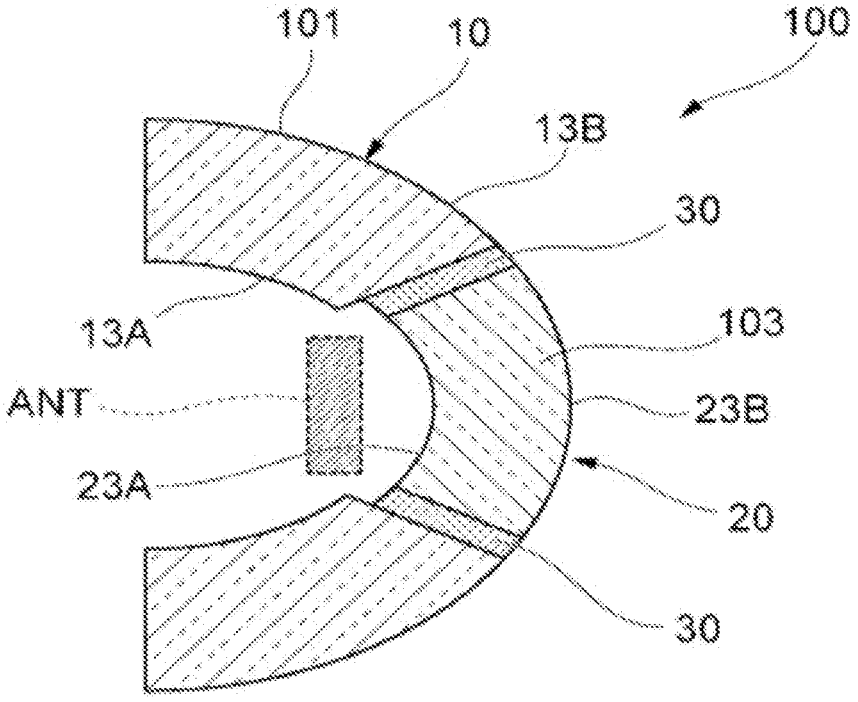
FIG. 14 is a cross-sectional view taken along line XIV-XIV in FIG. 12 when a display portion is arranged on a lateral surface of a protection target.

FIG. 13 is a cross-sectional view taken along line XIII-XIII of the protective member 100 illustrated in FIG. 12 when a display portion is arranged on a lateral surface of the protection target 1. FIG. 14 is a cross-sectional view taken along line XIV-XIV of the protective member 100 illustrated in FIG. 12.

As illustrated in FIG. 13, the second base material 20 has an inclined boundary surface 25 with its width increasing from outer side to inner side of the protective member 100. The first base material 10 also has a boundary surface 15 parallel to the boundary surface 25. Each of the boundary surfaces 15 and 25 is inclined from the main surface 13 of the first base material 10 and is visually inconspicuous.

As illustrated in FIG. 14, the outer-side surface 23B of the second base material 20 is smoothly connected to the outer-side surface 13B of the first base material 10 through an intermediate material 30. In the case where the display portion is thus arranged on the lateral surface of the protection target 1, the step between the flat surface portion 101 and the curved portion 103 of the protective member 100 is preferably set to, for example, 10 μm or less. Thereby, the visibility of the display portion is not reduced.

Figure 15:
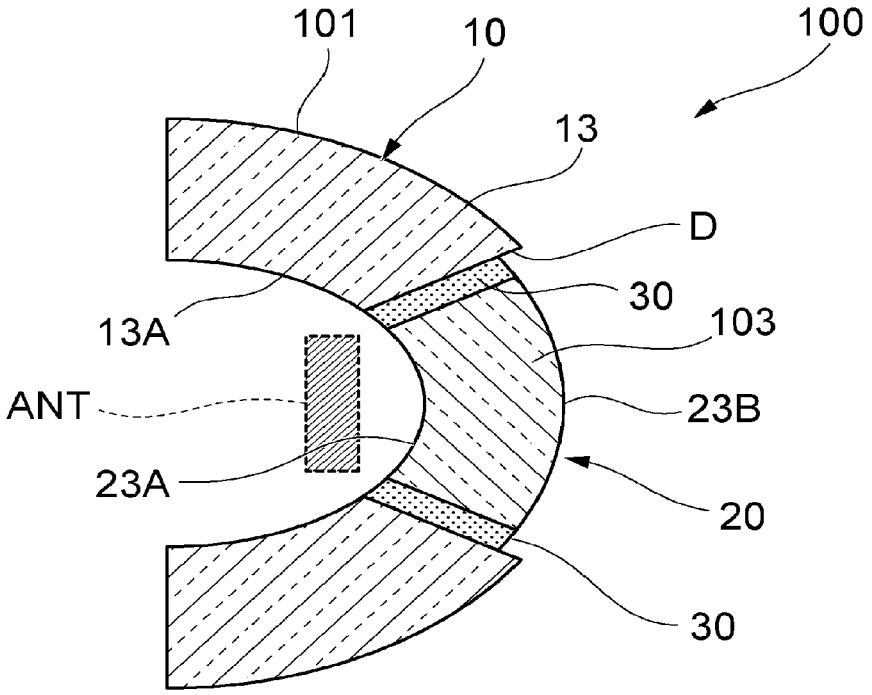
FIG. 15 is a cross-sectional view taken along line XIV-XIV in FIG. 12 when a display portion is not arranged on a lateral surface of a protection target.

FIG. 15 is a cross-sectional view taken along line XIV-XIV of the protective member illustrated in FIG. 12 when a display portion is not arranged on a lateral surface of the protection target 1.

In the case where the display portion is not arranged on a lateral surface of the protection target 1, the visibility of the display portion need not be taken into consideration, and a step D of 100 μm or less may be present between the flat surface portion 101 and the curved portion 103 of the protective member 100.

Also, in the case where an antenna ANT is provided on a lateral surface of the protection target as indicated by a dotted line in FIG. 14 and FIG. 15, the curved portion 103 that is the second base material 20 is arranged at a position facing the antenna ANT. Such an arrangement enables passing radio waves through the second base material 20 in the lateral side of the protection target 1 and ensuring good communication.

[Sixth Embodiment] (Protective Member Not Including Intermediate Material)

In all of the configurations illustrated in FIG. 2 to FIG. 5 where the second base material 20 is fitted in the hole 11 penetrating front and back of the first base material 10, the configurations illustrated in FIG. 8 and FIG. 9 where the second base material 20 is fitted in the hole 17 that is formed in the first base material 10 and recessed in the thickness direction of the first base material, and the configurations illustrated in FIG. 13 to FIG. 15 where the second base material 20 is provided in the curves portion or a part of the curved portion, the first base material 10 and the second base material 20 are joined through an intermediate material 30. However, a configuration where a first base material 10 and a second base material 20 are directly joined and an intermediate material 30 is not present between the first base material 10 and the second base material 20 may also be adopted. For example, the first base material 10 and the second base material 20 may be integrated by fusion, pressure bonding or chemical bonding of either one or by fusion, pressure bonding or chemical bonding of both.

Figure 16:
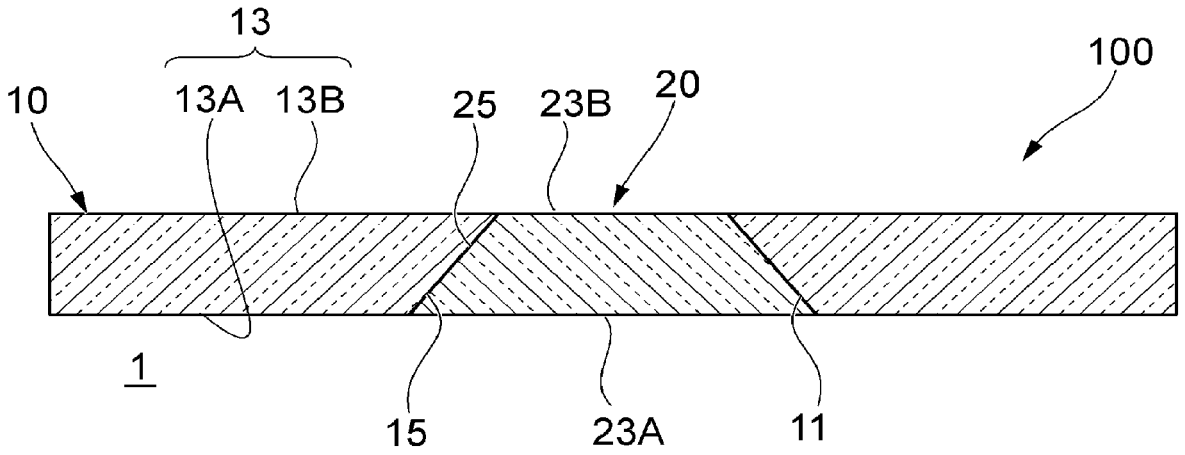
FIG. 16 is a cross-sectional view illustrating a protective member where the second base material is joined to a hole penetrating in the thickness direction of a first base material.

FIG. 16 is a cross-sectional view illustrating a protective member 100 where a second base material 20 is joined to a hole 11 penetrating in the thickness direction of a first base material 10.

In the protective member 100 illustrated in FIG. 16, a second base material 20 is fitted in the hole 11 of the first base material 10 and fused to effect integration. In addition, the second base material 20 may also be formed by fixing the first base material 10 to a forming mold and then filling the hole 11 with a liquid resin.

Figure 17:
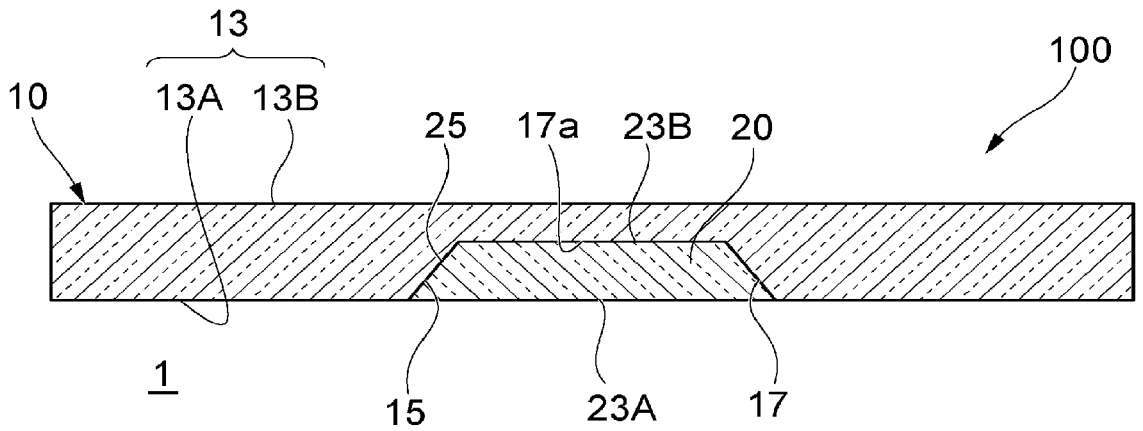
FIG. 17 is a cross-sectional view illustrating a protective member where the second base material is joined to a hole recessed in the thickness direction of a first base material.

FIG. 17 is a cross-sectional view illustrating a protective member 100 where a second base material 20 is joined to a hole 17 recessed in the thickness direction of a first base material 10.

As illustrated in FIG. 17, in the protective member 100, the base materials may be integrated by fitting the second base material 20 in the hole 17 formed by a thinning of the wall of the first base material 10 and then fusing the second base material 20, or the hole may be filled with a liquid resin.

In addition, the second base material 20 provided in the protective member 100 may not only be in a single individual form but may also be an aggregate of a plurality of individual base materials.

Figure 18:
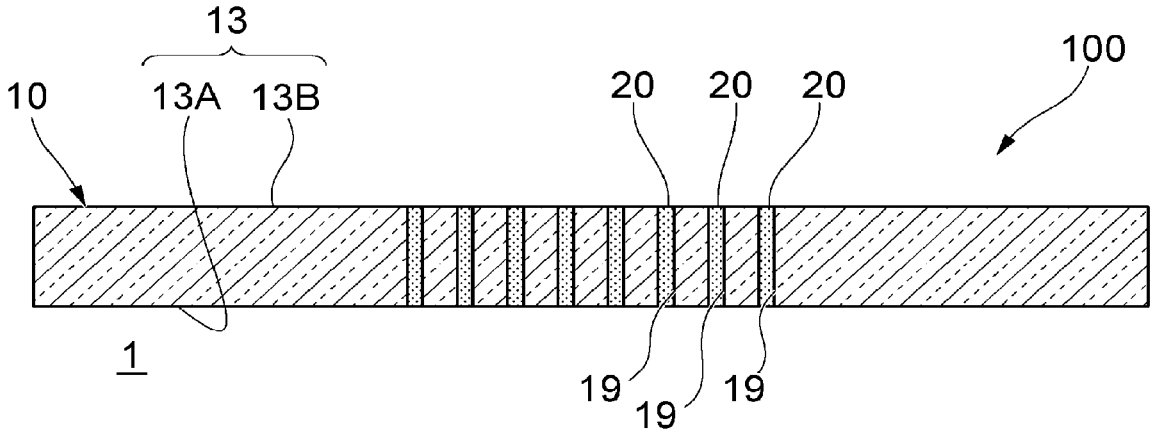
FIG. 18 is a cross-sectional view of a protective member where a second base material is provided in a plurality of holes penetrating in the thickness direction of a first base material.

FIG. 18 is a cross-sectional view of a protective member where a second base material 20 is provided in a plurality of holes 19 penetrating in the thickness direction of a first base material 10.

In this protective member 100, a plurality of holes 19 penetrating front and back of a first base material 10 are formed, and a second base material 20 is provided in these holes 19. The hole 19 is not limited to a hole having a cross-sectional circular, polygonal or other shapes and extending in the thickness direction of the first base material 10 but may be a slit-shaped hole extending in a direction perpendicular to the thickness direction of the first base material. In this case, when holes at intervals smaller than the wavelength of electromagnetic waves are formed and the second base material is provided in the holes, this makes it possible to have average dielectric properties. Then, in a region where the second base material 20 is provided in a plurality of holes 19, the electromagnetic permeability at a frequency band of 10 GHz band can be increased to allow for good communication.

In the case where the first base material 10 and the second base material 20 are joined without interposition of an intermediate material 30, a difference between the refractive index of the first base material 10 at the helium d line and the refractive index of the second base material 20 at the helium d line is preferably 0.02 or less, more preferably 0.01 or less. Within this range, an unpleasant feeling due to a difference in the refractive index is more suppressed.

<Details of Material of Protective Member> (Material of First Base Material)

The first base material 10 is formed of a glass (alumino-borosilicate glass, aluminosilicate glass, soda lime silicate glass, crystallized glass, etc.) for chemical strengthening, which includes a network forming material that has $SiO_2$ as a main component, and the glass is preferably chemically strengthened. In the chemically strengthened glass, it is preferred that the depth of the compressive stress layer is 5 μm or more and the surface compressive stress of the compressive stress layer is 300 MPa or more. In order to effectively perform the chemical strengthening, the total content of alkali metal oxides in the composition of the material A forming the first base material 10 is preferably 10 mol % or more, more preferably 15 mol % or more. The total content of alkali metal oxides in the composition of the material A forming the first base material 10 is preferably 35 mol % or less, more preferably 25 mol % or less. Also, the content of aluminum oxide is preferably 6 mol % or more, more preferably 10 mol % or more. The content of aluminum oxide is preferably 30 mol % or less, more preferably 20 mol % or less.

Here, the first base material 10 is formed by melting and hardening a raw material composition. The production method of the first base material 10 is not particularly limited, but, for example, a method where a general molten glass is formed to a predetermined plate thickness by a float process and after cooling slowly, cut into a desired shape to obtain a plate glass, can be adopted.

In addition, "$SiO_2$ as a main component" as used herein means that the content of $SiO_2$ is maximum in terms of the ratio of components by mol % based on an oxide.

(Strengthening Treatment)

The first base material 10 is chemically strengthened. The chemical strengthening method is a method where a glass base material is immersed in a molten salt of potassium nitrate at a temperature not more than the glass transition point to effect ion exchange and alkali metal ions (typically, Li ion and Na ion) having a small ionic radius present in the main surface of the glass base material are thereby replaced by alkali ions (typically, Na ion or K ion for Li ion, and K ion for Na ion) having a larger ionic radius.

As for the first base material 10, the glass main surface is subjected to the strengthening treatment and therefore, a glass having a high mechanical strength is obtained. In the present configuration, any strengthening method may be adopted, but in the case of obtaining a glass having a small thickness and a large compressive stress (CS) value, the strengthening is preferably performed by a chemical strengthening method.

Here, the strengthening property (strengthening profile) of a chemically strengthened glass is generally expressed by a compressive stress formed in the surface of the glass (CS: Compressive stress), the depth of the compressive stress (DOL: Depth of layer), and the tensile stress formed inside the glass (CT: Central tension).

In the first base material 10, a compressive stress layer is formed in the glass main surface. The compressive stress (CS) of the compressive stress layer is preferably 300 MPa or more, more preferably 500 MPa or more, still more preferably 600 MPa or more, yet still more preferably 700 MPa or more. Because of an increase in the compressive stress (CS), the mechanical strength of the strengthened glass increases. On the other hand, if the compressive stress (CS) is excessively increased, the tensile stress inside the glass may extremely increase. Therefore, the compressive stress (CS) is preferably 1,800 MPa or less, more preferably 1,500 MPa or less, still more preferably 1,200 MPa or less.

The depth of the compressive stress layer (DOL) is preferably 5 μm or more, more preferably 15 μm or more, still more preferably 30 μm or more. On the other hand, if DOL is excessively increased, the tensile stress inside the glass may extremely increase. Therefore, the depth of the compressive stress layer (DOL) is preferably 200 μm or less, more preferably 150 μm or less. In order to deepen DOL without extremely increasing the tensile stress, there is also a method of conducting two-step strengthening. By conducting chemical strengthening twice, a stress profile such that the compressive stress in the surface layer is large but the compressive stress in a deeper layer is small can be created.

The compressive stress (CS) and the depth of the compressive stress layer (DOL) formed in the main surface of the first base material 10 can be determined by observing the number of interference fringes and the intervals thereof by means of a surface stress meter (FSM-6000, manufactured by Orihara Industrial Co., Ltd.). As the measurement light source of FSM-6000, for example, a light source at a wavelength of 589 nm or 790 nm can be used. Incidentally, the surface compressive stress can also be measured utilizing a birefringence. In the case where the optical evaluation is difficult, it is also possible to estimate the surface compressive stress by using a mechanical strength evaluation such as three-point bending. Furthermore, for example, in the case of performing the strengthening in one step (one chemical strengthening), the tensile stress (CT; unit: MPa)

formed inside the first base material 10 can be calculated according to the following formula by using the compressive stress (CS; unit: MPa) and the depth of the compressive stress layer (DOL; unit: μm), which are measured above.

$$CT=\{CS\times(DOL\times10^{-3})\}/\{t-2\times(DOL\times10^{-3})\}$$

in which t (unit: mm) is the thickness of the glass base material.

In addition, the chemical strengthened glass used here preferably has, in the surface, at least one selected from the group consisting of sodium ions, silver ions, potassium ions, cesium ions and rubidium ions. In this case, a compressive stress is induced in the surface, and the glass is highly strengthened. As for the first base material 10, for example, a base material having a relative permittivity Dk of 5.5 to 8.5 and a dielectric loss tangent Df of 0.01 to 0.05 can be adopted.

(Material of Second Base Material)

The second base material 20 is preferably formed of a high-frequency device base material (a quartz glass, an aluminoborosilicate glass, a borosilicate glass, an alkali-free glass, a fluororesin, a polycarbonate resin, an acrylic resin, a urethane acrylate resin, a silicon resin, a cycloolefin polymer resin, a polyimide resin, a low-melting-point frit glass, etc.), where the dielectric loss tangent Df (tan δ) at 10 GHz is preferably 0.01 or less and the relative permittivity Dk at 10 GHz is preferably 6 or less. When the dielectric loss tangent Df at 10 GHz of the second base material 20 is 0.01 or less, the dielectric loss in a high frequency region can be reduced. Also, when the relative permittivity Dk at 10 GHz of the second base material 20 is 6 or less, the dielectric loss in a high frequency region can be reduced. The dielectric loss tangent Df at 10 GHz of the second base material 20 is more preferably 0.005 or less, still more preferably 0.003 or less. The dielectric loss tangent Df at 10 GHz of the second base material 20 is preferably close to 0. The relative permittivity Dk of the second base material 20 is more preferably 5.5 or less, still more preferably 5 or less, yet still more preferably 4.5 or less. The relative permittivity Dk of the second base material 20 is preferably close to 0. At least either one of the dielectric loss tangent Df and the relative permittivity Dk should be in the range above, and it is preferred that both are in the ranges above.

The second base material 20 having the above-described dielectric properties such as dielectric loss tangent can be realized by setting the total content of alkali metal oxides to 5 mol % or less in a glass base material which includes a network forming material that has $SiO_2$ as a main component. The total content of alkali metal oxides is more preferably 1 mol % or less, still more preferably 0.2 mol % or less. Here, the second base material 20 is formed by melting and hardening a raw material composition. The production method of the second base material 20 is not particularly limited, but, for example, a method where a general molten glass is formed to a predetermined thickness by a float process and after cooling slowly, cut into a desired shape to obtain a plate glass, can be adopted.

(Material of Intermediate Material)

The material of the intermediate material 30 is an optical adhesive material (an epoxy resin, a silicon resin, an acrylic resin, a urethane resin, a urethane acrylate resin, a vinyl chloride resin, a low-melting-point frit glass, etc.). The optical adhesive material contains the resin or frit glass above as a main component and in use, is appropriately combined with a curing agent, a polymerization initiator, solvent, a binder, a silane coupling agent, etc. In the case of using a resin, the resin is cured by heat or light, and the first base material 10 and the second base material 20 are thereby bonded. In the case of using a low-melting-point frit glass, the low-melting-point frit glass is softened by heat and thereafter cooled to effect solidification, and the first base material 10 and the second base material 20 are thereby bonded. The low-melting-point frit glass preferably contains, as a main component, for example, any one of bismuth oxide, boron oxide, lead oxide, phosphoric acid and tellurium oxide and has a softening point of 550° C. or less, more preferably 500° C. or less, still more preferably 450° C. or less.

The intermediate material 30 is preferably transparent to visible light.

In addition, the intermediate material 30 preferably has a refractive index between the refractive index of the first base material 10 at the helium d line and the refractive index of the second base material 20 at the helium d line. In this case, the refractive-index difference can be more reduced, and the unpleasant feeling in the outer appearance due to difference in the refractive index can be more successfully suppressed.

<Communication Terminal Device Including Protective Member>

According to a communication terminal device including the protective member having the above-mentioned configurations and a protection target to which the protective member is attached, the protective member is attached to the protection target, and the protection target can thereby be protected while reducing the radio wave propagation loss.

EXAMPLES

Next, the results when protective members were formed by combining a first base material and a second base material each formed of various materials and these protective members were evaluated for the radio wave permeability and the appearance of the boundary surface, are described.

As the first base material, three kinds of glasses A, B and C were prepared, and as the second base material, two kinds of glasses D and E and three kinds of resins A, B and C were prepared. Also, as the intermediate material, two kinds of resins differing in the refractive index were prepared. In all of the glasses A, B and C, the thickness is 0.7 mm.

In Table 1, with respect to the first base material, the refractive index, the values of relative permittivity Dk and dielectric loss tangent Df at a frequency of 10 GHz, the chemical strengthening treatment, and the compressive stress (CS) and the depth of the compressive stress layer (DOL), which are formed by the chemical strengthening, are shown together. In Table 2, with respect to the second base material, the refractive index and the values of relative permittivity Dk and dielectric loss tangent Df at a frequency of 10 GHz are shown together. In addition, the refractive index of the intermediate material is shown in Table 3. The refractive index as used herein is a refractive index at the helium d line. Furthermore, both the first base material and the second base material have a visible light transmittance of 70% or more. The relative permittivity Dk and the dielectric loss tangent Df are values measured by SPDR method or a cavity resonator.

TABLE 1

Properties of First Base Materials

| First Base Material | Refractive Index | Relative Permittivity Dk (10 GHz) | Dielectric Loss Tangent Df (10 GHz) | Chemical Strengthening | Stress |
|---|---|---|---|---|---|
| Glass A | 1.51 | 7.0 | 0.015 | One-step strengthening | CS = 750 [MPa], DOL = 30 [μm] |
| Glass B | 1.53 | 6.7 | 0.013 | Two-step strengthening | CS = 800 [MPa], DOL = 100 [μm] |
| Glass C | 1.59 | 7.4 | 0.007 | One-step strengthening | CS = 600 [MPa], DOL = 100 [μm] |

TABLE 2

Properties of Second Base Materials

| Second Base Material | Refractive Index | Relative Permittivity Dk (10 GHz) | Dielectric Loss Tangent Df (10 GHz) |
|---|---|---|---|
| Glass D | 1.52 | 5.3 | 0.006 |
| Glass E | 1.50 | 4.7 | 0.004 |

TABLE 2-continued

Properties of Second Base Materials

| Second Base Material | Refractive Index | Relative Permittivity Dk (10 GHz) | Dielectric Loss Tangent Df (10 GHz) |
|---|---|---|---|
| Resin A | 1.51 | 2.9 | 0.024 |
| Resin B | 1.60 | 2.5 | 0.0017 |
| Resin C | 1.59 | 2.6 | 0.006 |

TABLE 3

Refractive Index of Intermediate Materials

| | Refractive Index |
|---|---|
| Intermediate material A | 1.51 |
| Intermediate material B | 1.60 |

These first base material, second base material and intermediate material are arranged, as illustrated in FIG. 2, to incline the boundary surface at an inclination angle θ relative to the main surface of the first base material. The configurations and evaluation results of Test Examples 1 to 7 are shown in Table 4. As for the radio wave permeability, an antenna was arranged to face the inner-side surface of the protective member and by executing communication through the outer-side surface from the inner-side surface of the protective member, the evaluation was conducted on a four-grade scale, namely, AA: high-speed communication is always stably performed, A: good communication is performed without practical problem, B: the communication is rarely delayed, and C: the communication is lost. The appearance at the boundary was evaluated on a four-grade scale, namely, AA: the boundary is scarcely visible even when stared at, A: the boundary is not noticeable, B: the boundary is slightly visible, and C: the boundary is easily visible.

TABLE 4

Test Results

| | First Base Material | Scond Base Material | Intermediate Material | Inclination Angle θ(deg) | Radio Wave Permeability | Appearance of Boundary |
|---|---|---|---|---|---|---|
| Test Example 1 | Glass A | Glass D | Intermediate material A | 45 | A | AA |
| Test Example 2 | Glass A | Glass D | Intennediate material A | 60 | A | AA |
| Test Example 3 | Glass A | Glass D | intermediate material A | 90 | A | A |
| Test Example 4 | Glass A | Glass E | intermediate material A | 45 | A | AA |
| Test Example 5 | Glass A | Resin A | intermediate material A | 45 | A | AA |
| Test Example 6 | Glass B | Glass D | intermediate material A | 45 | A | AA |
| Test Example 7 | Glass C | Resin B | intermediate material B | 45 | AA | AA |
| Test Example 8 | Glass C | Resin C | intermediate material B | 45 | A | AA |
| Test Example 9 | Glass A | — | — | — | C | — |

In Test Example 1, the first base material was glass A having a refractive index of 1.52, the second base material was glass D having a refractive index of 1.52, and the first base material and the second base material were joined through intermediate material A having a refractive index of 1.51. The inclination angle θ of the boundary surface was 45°. The relative permittivity Dk of the second base material was 5.3, and the dielectric loss tangent Df was 0.006. As a result, the radio wave permeability was at a level where good communication is performed. In addition, good results that the boundary is scarcely visible in terms of outer appearance were produced, because the refractive-index difference at the boundary between the first base material and the intermediate material was 0, the refractive-index difference at the boundary between the second base material and the intermediate material was 0.01, and moreover, the boundary surface was inclined at an inclination angle of 45° relative to the main surface of the first base material.

Test Example 2 is the same configuration as Test Example 1 except that the inclination angle θ of Test Example 1 was changed to 60°. The same results as in Test Example 1 were obtained also in this case.

Test Example 3 is the same configuration as Test Example 1 except that the inclination angle θ of Test Example 1 was changed to 90°. In this case, although the inclination angle θ was orthogonal to the main surface of the first base material, the refractive-index difference at the boundary was small and therefore, the boundary was in an unnoticeable level.

In Test Example 4, the second base material of Test Example 1 was changed to glass E having a refractive index of 1.50, a relative permittivity Dk of 4.7 and a dielectric loss tangent Df of 0.004. The inclination angle θ of the boundary surface was 45°. In this case, the same evaluation results as in Test Example 1 were obtained.

In Test Example 5, the second base material of Test Example 1 was changed to resin A having a refractive index of 1.51, a relative permittivity Dk of 2.9 and a dielectric loss tangent Df of 0.024, and all of the refractive indexes of the first base material, the second base material, and the intermediate material were equalized. The inclination angle θ of the boundary surface was 45°. As a result, the radio wave permeability was good and, among others, the appearance at the boundary was improved.

In Test Example 6, the first base material was glass B being strengthened in two steps and having a refractive index of 1.53, the second base material was glass D having a refractive index of 1.52, and the first base material and the second base material were joined through intermediate material A having a refractive index of 1.51. The relative permittivity Dk of the second base material was 5.3, and the dielectric loss tangent Df was 0.006. The inclination angle θ of the boundary surface was 45°. As a result, the radio wave permeability was at a level where good communication is performed. In addition, the refractive-index difference at the boundary between the first base material and the intermediate material was 0.02, and the refractive index difference at the boundary between the second base material and the intermediate material was 0.01. Thus, the refractive-index differences were 0.02 or less, and the boundary surface was inclined at an inclination angle θ of 45° relative to the main surface of the first base material. Consequently, among others, the appearance at the boundary was improved.

In Test Example 7, the first base material was glass C being strengthened in one step and having a refractive index of 1.59, and the second base material was changed to resin B having a refractive index of 1.60, a relative permittivity Dk of 2.5 and a dielectric loss tangent Df of 0.0017. In addition, the inclination angle θ of the boundary surface was 45°. As a result, particularly, good communication was performed, and, among others, the appearance at the boundary was improved.

In Test Example 8, the second base material of Test Example 7 was changed to resin C having a refractive index of 1.59, a relative permittivity Dk of 2.6 and a dielectric loss tangent Df of 0.006. The inclination angle θ of the boundary surface was 45°. As a result, good communication was performed, and, among others, the appearance at the boundary was improved.

In Test Examples 1 to 8, the values of relative permittivity Dk and dielectric loss tangent Df at a frequency of 10 GHz of the first base material and the second base material satisfy the requirement that the value of at least either one of the relative permittivity Dk and the dielectric loss tangent Df of the second base material is smaller than the value of the relative permittivity or the dielectric loss tangent of the first base material. Consequently, good communication could be performed in all of these Test Examples.

Also, in Test Examples 1 to 8 where the refractive-index difference at the boundary surface was 0.02 or less, the appearance of the boundary surface was improved. Particularly, in Test Examples 1, 2 and 4 to 8 where the inclination angle of the boundary surface was 20° or more and less than 75°, the boundary was scarcely visible in the boundary surface.

Test Example 9 was a configuration composed of only a first base material and not including a second base material. In this case, since a boundary did not exist, the appearance was not reduced, but the communication was sometimes unstable.

The present invention described hereinbefore is not limited to the embodiments above, but mutual combinations of respective configurations of these embodiments as well as modifications and applications by one skilled in the art based on the present description and well-known technology are also intended in the present invention and included in the scope seeking protection.

By way of example, a smartphone is illustrated as a communication terminal device (portable communication terminal device) including a protective member and a protection target member to which the protective member is attached, but such a communication terminal device includes an electronic device, etc. having a communication function capable of establishing a connection to the host or the network and thereby performing data communication, the electronic device being a portable compact electronic device such as digital camera or game machine.

As described in the foregoing pages, the present description discloses the following matters.

(1) A protective member having a plate shape, including:

a first base material that is a chemically strengthened glass, and a second base material provided in a hole recessed or penetrating in a thickness direction of the first base material and formed of a material different from a material forming the first base material, in which with respect to values of relative permittivity and dielectric loss tangent at a frequency of 10 GHz of the first base material and the second base material, the value of at least either one of the relative permittivity and the dielectric loss tangent of the second base material is smaller than the value of the relative permittivity or the dielectric loss tangent of the first base material.

According to this protective member, the value of at least either one of relative permittivity and dielectric loss tangent at a frequency of 10 GHz of the second base material is smaller than the value of the relative permittivity or the dielectric loss tangent of the first base material, so that the electromagnetic permeability at a frequency band of 10 GHz band in the second base material can be higher than the electromagnetic permeability in the first base material. Consequently, communication through the second base material can be performed with low loss. This makes it possible to successfully perform communication using radio waves, for example, at a frequency band of 10 GHz in a fifth-generation mobile communication system (5G), etc.

(2) The protective member according to (1), in which out of boundary surfaces between the first base material and the second base material, the boundary surface extending in the thickness direction of the first base material is inclined relative to a main surface of the first base material.

According to this protective member, the boundary between the first base material and the second base material is visually inconspicuous, so that reduction in the outer appearance can be suppressed.

(3) The protective member according to (2), in which an inclination angle of the boundary surface relative to the main surface is 20° or more and less than 75°.

According to this protective member, the boundary between the first base material and the second base material can more unfailingly be made visually inconspicuous.

(4) The protective member according to any one of (1) to (3), in which a difference between a refractive index of the first base material at a helium d line and a refractive index of the second base material at the helium d line is 0.02 or less.

According to this protective member, an unpleasant feeling in the outer appearance at the boundary surface due to a refractive-index difference between the first base material and the second base material can be reduced.

(5) The protective member according to (1) to (4), in which an intermediate material is provided between the first base material and the second base material.

According to this protective member, the first base material and the second base material can be easily integrated by the intermediate material.

(6) The protective member according to (5), in which a difference between the refractive index of the intermediate material at the helium d line and the refractive index of the first base material at the helium d line is 0.02 or less and a difference between the refractive index of the intermediate material at the helium d line and the refractive index of the second base material at the helium d line is 0.02 or less.

According to this protective member, an unpleasant feeling such as transparency impairment at the boundary surface due to a refractive-index difference between the first base material and the intermediate material and a refractive-index difference between the second base material and the intermediate material can be suppressed.

(7) The protective member according to (5) or (6), in which the intermediate material has a refractive index between the refractive index of the first base material at the helium d line and the refractive index of the second base material at the helium d line.

According to this protective member, the refractive-index difference between the intermediate material and the first base material and the refractive-index difference between the intermediate material and the second base material can be more reduced, and an unpleasant feeling in the outer appearance due to a difference in the refractive index can be more suppressed.

(8) The protective member according to any one of (1) to (7), in which the first base material has a thickness of 1.5 mm or less.

According to this protective member, a suitable thickness is achieved, for example, when used as a cover glass of a communication terminal device such as mobile phone and smartphone.

(9) The protective member according to any one of (1) to (8), in which in the second base material, the relative permittivity at a frequency band of 10 GHz is 6 or less.

According to this protective member, communication at a frequency band of 10 GHz band through the second base material can be performed with low loss.

(10) The protective member according to any one of (1) to (8), in which in the second base material, the dielectric loss tangent at a frequency band of 10 GHz is 0.01 or less.

According to this protective member, communication at a frequency band of 10 GHz band through the second base material can be performed with low loss.

(11) The protective member according to any one of (1) to (10), in which the second base material is formed of a glass material, and an alkali metal oxide content in the second base material is 5 mol % or less and ½ or less of an alkali metal oxide content in the first base material.

According to this protective member, the alkali metal oxide content in the second base material is smaller than in the first base material, so that the dielectric loss property can be more lowered than that of the first base material.

(12) The protective member according to any one of (1) to (11), in which the first base material has the hole penetrating in the thickness direction of the first base material and the second base material is fitted in the hole.

According to this protective member, the second base material is fitted in the hole of the first base material, so that the first base material and the second base material can be easily integrated.

(13) The protective member according to any one of (1) to (11), in which the first base material has the hole recessed in the thickness direction of the first base material and the second base material is fitted in the hole.

According to this protective member, the second base material is fitted in the hole of the first base material, so that the first base material and the second base material can be easily integrated. In addition, the side opposite the side where the second base material is fitted in the hole of the first base material can be made to be an opening-free smooth surface. Consequently, in the case of exposing the surface on the above-described opposite side of the first base material, the tactile sensation of the exposed surface can be improved.

(14) The protective member according to any one of (1) to (13), in which a step between the first base material and the second base material in the thickness direction of the first base material is 10 μm or less.

According to this protective member, the step between the first base material and the second base material is 5 μm or less and therefore, for example, in the case of viewing the display portion through the step, the visibility of the display portion is not reduced. In addition, since the step is small, the tactile sensation of the stepped surface is not impaired.

(15) The protective member according to any one of claim (1) to (14), wherein a curved portion is provided at least in either one edge portion of the protective member, and the second base material is arranged in part of the curved portion.

According to this protective member, communication can be performed through the second base material from the curved portion.

(16) A communication terminal device including:

the protective member according to any one of (1) to (15), and a protection target to which the protective member is attached.

According to this communication terminal device, the protective member is attached to the protection target, and the protection target can thereby be protected while reducing the radio wave propagation loss.

(17) The communication terminal device according to (16), in which an antenna is arranged at a position facing the second base material in a thickness direction of the second base material.

According to this communication terminal device, communication by the antenna is performed through the second base material from the rear surface to the front surface of the second base material, so that low-loss communication can be achieved.

(18) The communication terminal device according to (16), in which an antenna is arranged on an inner-side surface of the second base material.

According to this communication terminal device, the workability of antenna arrangement can be enhanced and in addition, good communication can be performed with low loss through the second base material.

(19) The communication terminal device according to (16), in which an antenna is buried inside the second base material.

According to this communication terminal device, the antenna can be unfailingly protected by burying the antenna inside the second base material, and low-loss communication can be performed through the second base material.

(20) The communication terminal device according to (16), in which an antenna is arranged between a bottom surface of the hole recessed in the thickness direction of the first base material and the second base material.

According to this communication terminal device, the antenna can be easily arranged between the bottom surface of the hole and the second base material, and the workability of antenna arrangement can be enhanced. In addition, the antenna arranged on the inside of the hole can be unfailingly protected.

This application is based on Japanese Patent Application (Japanese Patent Application No. 2020-102549) filed on Jun. 12, 2020, the contents of which are incorporated herein by way of reference.

1: Protection target (communication terminal device)
3: Display portion
10: First base material
11: Hole
13: Main surface
13A: Inner-side surface
13B: Outer-side surface
15, 25: Boundary surface
17: Hole (Recess)
17*a*: Bottom surface
19: Hole
20: Second base material
23A: Inner-side surface
23B: Outer-side surface
30: Intermediate material
100: Protective member
101: Flat surface portion
103: Curved portion
ANT: Antenna
D: Step
θ, θ1, θ2: Inclination angle

What is claimed is:

1. A protective member having a plate shape, comprising:

a first base material that is a chemically strengthened glass, and a second base material provided in a hole recessed or penetrating in a thickness direction of the first base material and formed of a material different from a material forming the first base material, wherein with respect to values of relative permittivity and dielectric loss tangent at a frequency of 10 GHz of the first base material and the second base material, the value of at least either one of the relative permittivity and the dielectric loss tangent of the second base material is smaller than the value of the relative permittivity or the dielectric loss tangent of the first base material, wherein out of boundary surfaces between the first base material and the second base material, the boundary surface extending in the thickness direction of the first base material is inclined relative to a main surface of the first base material.

2. The protective member according to claim 1, wherein an inclination angle of the boundary surface relative to the main surface is 20° or more and less than 75°.

3. The protective member according to claim 1, wherein a difference between a refractive index of the first base material at a helium d line and a refractive index of the second base material at the helium d line is 0.02 or less.

4. The protective member according to claim 1, wherein the first base material has a thickness of 1.5 mm or less.

5. The protective member according to claim 1, wherein in the second base material, the relative permittivity at a frequency band of 10 GHz is 6 or less.

6. The protective member according to claim 1, wherein in the second base material, the dielectric loss tangent at a frequency band of 10 GHz is 0.01 or less.

7. The protective member according to claim 1, wherein the first base material has the hole penetrating in the thickness direction of the first base material and the second base material is fitted in the hole.

8. The protective member according to claim 1, wherein the first base material has the hole recessed in the thickness direction of the first base material and the second base material is fitted in the hole.

9. A communication terminal device comprising:

the protective member according to claim 1, and a protection target to which the protective member is attached.

10. The communication terminal device according to claim 9, wherein an antenna is arranged at a position facing the second base material in a thickness direction of the second base material.

11. The communication terminal device according to claim 9, wherein an antenna is arranged on an inner-side surface of the second base material.

12. The communication terminal device according to claim 9, wherein an antenna is buried inside the second base material.

13. The communication terminal device according to claim 9, wherein an antenna is arranged between a bottom surface of the hole recessed in the thickness direction of the first base material and the second base material.

14. A protective member having a plate shape, comprising:

a first base material that is a chemically strengthened glass, and a second base material provided in a hole recessed or penetrating in a thickness direction of the first base material and formed of a material different from a material forming the first base material, wherein with respect to values of relative permittivity and dielectric loss tangent at a frequency of 10 GHz of the first base material and the second base material, the value of at least either one of the relative permittivity and the dielectric loss tangent of the second base material is smaller than the value of the relative permittivity or the dielectric loss tangent of the first base material, wherein an intermediate material is provided between the first base material and the second base material.

15. The protective member according to claim 14, wherein a difference between the refractive index of the intermediate material at the helium d line and the refractive index of the first base material at the helium d line is 0.02 or less and a difference between the refractive index of the intermediate material at the helium d line and the refractive index of the second base material at the helium d line is 0.02 or less.

16. The protective member according to claim 14, wherein the intermediate material has a refractive index between the refractive index of the first base material at the helium d line and the refractive index of the second base material at the helium d line.

17. A protective member having a plate shape, comprising:

a first base material that is a chemically strengthened glass, and a second base material provided in a hole recessed or penetrating in a thickness direction of the first base material and formed of a material different from a material forming the first base material, wherein with respect to values of relative permittivity and dielectric loss tangent at a frequency of 10 GHz of the first base material and the second base material, the value of at least either one of the relative permittivity and the dielectric loss tangent of the second base material is smaller than the value of the relative permittivity or the dielectric loss tangent of the first base material, wherein the second base material is formed of a glass material, and an alkali metal oxide content in the second base material is 5 mol % or less and ½ or less of an alkali metal oxide content in the first base material.

18. A protective member having a plate shape, comprising:

a first base material that is a chemically strengthened glass, and a second base material provided in a hole recessed or penetrating in a thickness direction of the first base material and formed of a material different from a material forming the first base material, wherein with respect to values of relative permittivity and dielectric loss tangent at a frequency of 10 GHz of the first base material and the second base material, the value of at least either one of the relative permittivity and the dielectric loss tangent of the second base material is smaller than the value of the relative permittivity or the dielectric loss tangent of the first base material, wherein a step between the first base material and the second base material in the thickness direction of the first base material is 10 μm or less.

19. A protective member having a plate shape comprising:

a first base material that is a chemically strengthened glass, and a second base material provided in a hole recessed or penetrating in a thickness direction of the first base material and formed of a material different from a material forming the first base material, wherein with respect to values of relative permittivity and dielectric loss tangent at a frequency of 10 GHz of the first base material and the second base material, the value of at least either one of the relative permittivity and the dielectric loss tangent of the second base material is smaller than the value of the relative permittivity or the dielectric loss tangent of the first base material, wherein a curved portion is provided at least in either one edge portion of the protective member, and the second base material is arranged in part of the curved portion.

* * * * *